US009938036B2

(12) United States Patent
Robertson

(10) Patent No.: US 9,938,036 B2
(45) **Date of Patent: *Apr. 10, 2018**

(54) CLAMSHELL CONTAINER WITH ANTI-BIND FEATURE

(71) Applicant: Huhtamaki, Inc., De Soto, KS (US)

(72) Inventor: Ronald D. Robertson, Kansas City, MO (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/401,885

(22) Filed: Jan. 9, 2017

(65) Prior Publication Data

US 2017/0144793 A1 May 25, 2017

Related U.S. Application Data

(63) Continuation of application No. 14/213,681, filed on Mar. 14, 2014, now Pat. No. 9,540,135.

(60) Provisional application No. 61/784,428, filed on Mar. 14, 2013.

(51) Int. Cl.

| | |
|---|---|
| ***B65D 5/66*** | (2006.01) |
| ***B65D 5/00*** | (2006.01) |
| ***B65D 5/42*** | (2006.01) |
| ***B65D 5/18*** | (2006.01) |

(52) U.S. Cl.

CPC ..... *B65D 5/0085* (2013.01); *B65D 5/18* (2013.01); *B65D 5/4266* (2013.01); *B65D 5/667* (2013.01)

(58) Field of Classification Search

CPC ..... B65D 5/667; B65D 5/4266; B65D 5/302; B65D 5/66; Y10S 229/92; Y10S 229/93

USPC ..... 229/920, 902, 931, 930, 146, 114, 906, 229/148, 149

See application file for complete search history.

(56) References Cited

U.S. PATENT DOCUMENTS

| | | | | |
|---|---|---|---|---|
| 4,022,372 | A | 5/1977 | Graser | |
| 4,232,816 | A | 11/1980 | Johnson et al. | |
| 4,570,845 | A | 2/1986 | Hall | |
| 4,877,178 | A | 10/1989 | Eisman | |
| 4,951,865 | A | 8/1990 | Eisman | |
| 5,117,973 | A * | 6/1992 | Lo Duca | B65D 5/18 206/45.29 |
| 5,205,476 | A | 4/1993 | Sorenson | |
| 5,221,040 | A | 6/1993 | Sorenson | |
| 5,332,147 | A * | 7/1994 | Sorenson | B65D 5/6626 229/114 |
| 5,377,903 | A * | 1/1995 | Gordon | B65D 5/2023 229/104 |
| 5,388,758 | A | 2/1995 | Scovell | |
| 5,553,772 | A | 9/1996 | Jensen | |
| 5,788,145 | A | 8/1998 | Grahahm et al. | |
| 5,921,466 | A | 7/1999 | Speese et al. | |

(Continued)

*Primary Examiner* — Christopher Demeree

(74) *Attorney, Agent, or Firm* — Husch Blackwell LLP

(57) ABSTRACT

A clamshell container having an anti-bind feature is provided. The container is comprised of a tray and a cover, each having a first panel and rear panel foldably connected along a rear fold line. One or both of the rear fold lines may be interrupted by a cut suitable for allowing the rear panels to flex or bow when the cover is hingedly rotated relative to the tray. A rear cut may be provided generally coextensive with each of the fold lines. The cuts can have an arcuate shape and may be convexly curved toward an interior of the container.

16 Claims, 3 Drawing Sheets

(56) References Cited

U.S. PATENT DOCUMENTS

| | | | | |
|---|---|---|---|---|
| 6,041,997 | A | 3/2000 | Jensen | |
| 6,196,448 | B1 * | 3/2001 | Correll | B65D 5/42 229/103.11 |
| 7,263,869 | B2 | 9/2007 | Durney et al. | |
| 8,733,622 | B2 | 5/2014 | Learn | |
| 2007/0108262 | A1 * | 5/2007 | D'Amato | B65D 5/667 229/146 |
| 2008/0110966 | A1 * | 5/2008 | Yocum | B65D 5/667 229/114 |
| 2011/0315753 | A1 | 12/2011 | Learn | |
| 2012/0000972 | A1 | 1/2012 | Learn | |

* cited by examiner

CLAMSHELL CONTAINER WITH ANTI-BIND FEATURE

CROSS-REFERENCE TO RELATED APPLICATIONS

This Application claims priority to U.S. patent application Ser. No. 14/213,681, filed on Mar. 14, 2014, to Ronald D. Robertson entitled "Clamshell Container with Anti-Bind Feature," currently pending, the entire disclosure of which is incorporated herein by reference, which claims priority to U.S. Provisional Patent Application Serial No. 61/784,428, filed on Mar. 14, 2013, to Ronald D. Robertson entitled "Clamshell Container with Anti-Bind Feature," now expired, the entire disclosure of which is incorporated herein by reference.

BACKGROUND OF THE INVENTION

Clamshell containers are popular in the fast food and carry-out industries and are often formed from a single unitary blank of paperboard material. These containers have been met with widespread acceptance, are relatively inexpensive to manufacture and can be recycled after use. However, one problem that has been encountered with such clamshell containers has been their tendency to buckle or bind along their back wall panels as they are being closed by restaurant crew or opened by customers. For example, when a top cover portion is lifted and folded back on a center hinge in the rear portion of the container, the region adjacent the hinge and rear wall panels tends to flex and bow. This problem is sometimes referred to as "oil canning" because a portion of the rear region of the container can distort as the opening begins and then eventually pop back into its proper and intended configuration. In some instances, the act of trying to fully open the cover and forcibly overcome the buckling can result in a torn container and/or spilled contents.

As such, a need exists for a simple and effective anti-binding construction for a clamshell container formed from a unitary blank of paperboard or other suitable material.

SUMMARY OF THE INVENTION

One embodiment of the present invention is directed to a clamshell container having a tray portion, a cover portion and an anti-bind feature for minimizing or entirely eliminating binding as the cover portion is moved between open- and closed positions relative to the tray portion. In one embodiment, the tray portion is constructed of a bottom panel having a front panel, rear panel, first end panel and second end panel extending generally upwardly therefrom. Likewise, the cover portion can include a top panel having a front panel, rear panel, first end panel and second end panel extending generally downwardly therefrom.

The bottom tray panel and rear tray panel can be foldably connected along a rear tray fold line. Similarly, the top cover panel and rear cover panel can be foldably connected along a rear cover fold line. The rear tray fold line and rear cover fold line may each be interrupted or otherwise broken by one or more rear cuts, which may be defined proximate mid-sections of the rear tray fold line and rear cover fold line. The rear cuts can intersect the rear tray fold line and rear cover fold line and, in one instance, are generally coextensive with each of the rear tray fold line and rear cover fold line. In one embodiment, the rear cuts have an arcuate shape and may be convexly curved toward an interior of the container. The rear cuts are adapted for allowing one or both of the rear tray panel and rear cover panel to flex or bow inwardly as the cover portion is hingedly rotated relative to the tray portion.

In one embodiment, the bottom tray panel and front tray panel are foldably connected along a front tray fold line and, similarly, the top cover panel and front cover panel are foldably connected along a front cover fold line. One or more front cuts may be provided generally coextensive with at least one of the front tray fold line and front cover fold line. The front cuts may be at least partially laterally offset from the rear cuts. The front cuts may be located proximate opposing ends of the front tray fold line and front cover fold line.

It is a further object of the present invention to provide a foldable blank for forming the container. The blank may be die cut from a larger sheet or roll of paperboard material. The blank can include score lines and/or fold lines to facilitate formation of the container in a folding process. The rear cuts and front cuts may be die cut simultaneously with the blank.

Other aspects and advantages of the present invention will be apparent from the following detailed description of the preferred embodiments and the accompanying drawing figures.

DESCRIPTION OF THE SEVERAL VIEWS OF THE DRAWINGS

In the accompanying drawings, which fonn a part of the specification and are to be read in conjunction therewith in which like reference numerals are used to indicate like or similar parts in the various views.

DETAILED DESCRIPTION OF THE INVENTION

Figure 1:
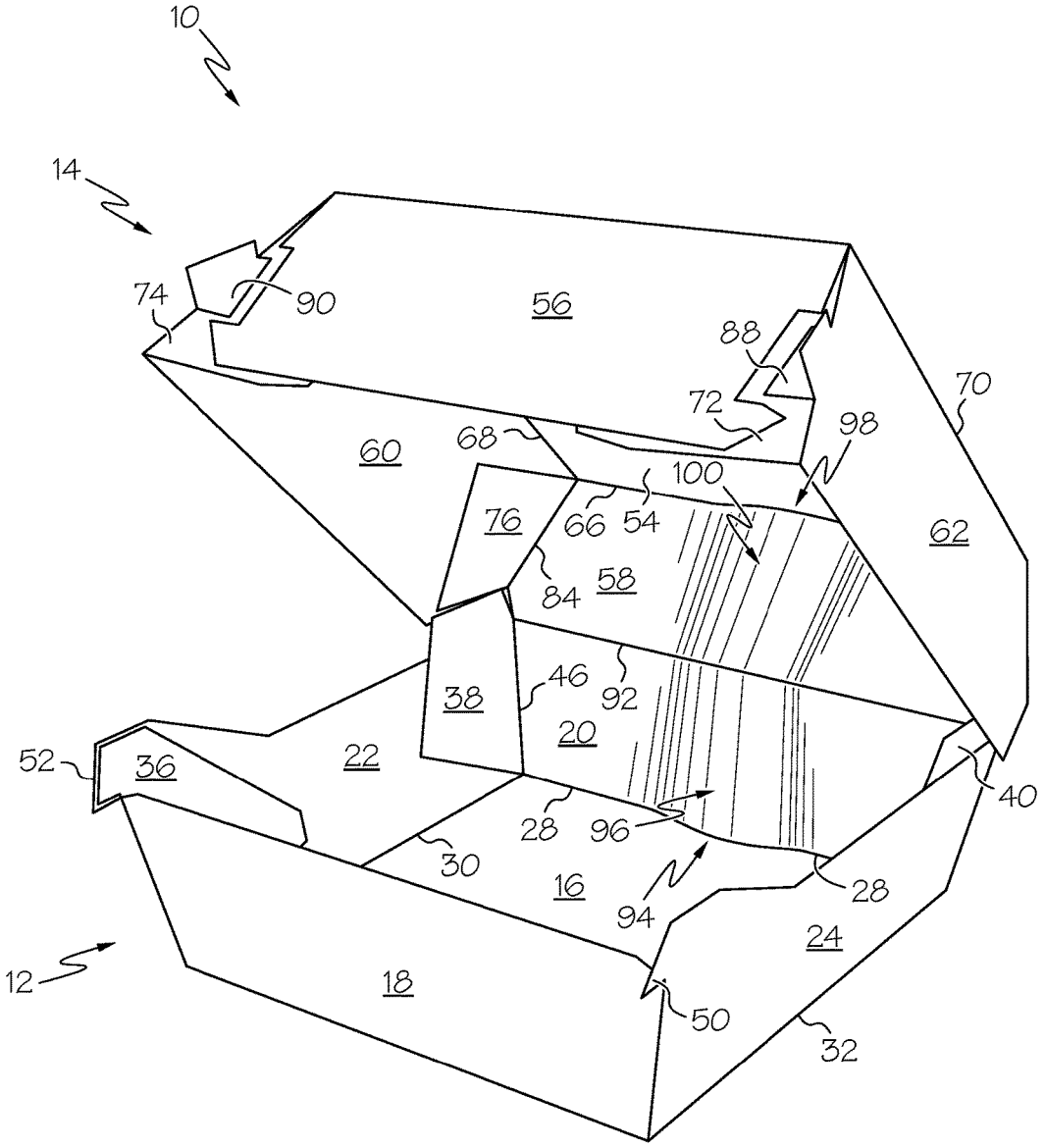
FIG. 1 is a side perspective view of a clamshell container constructed according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 2:
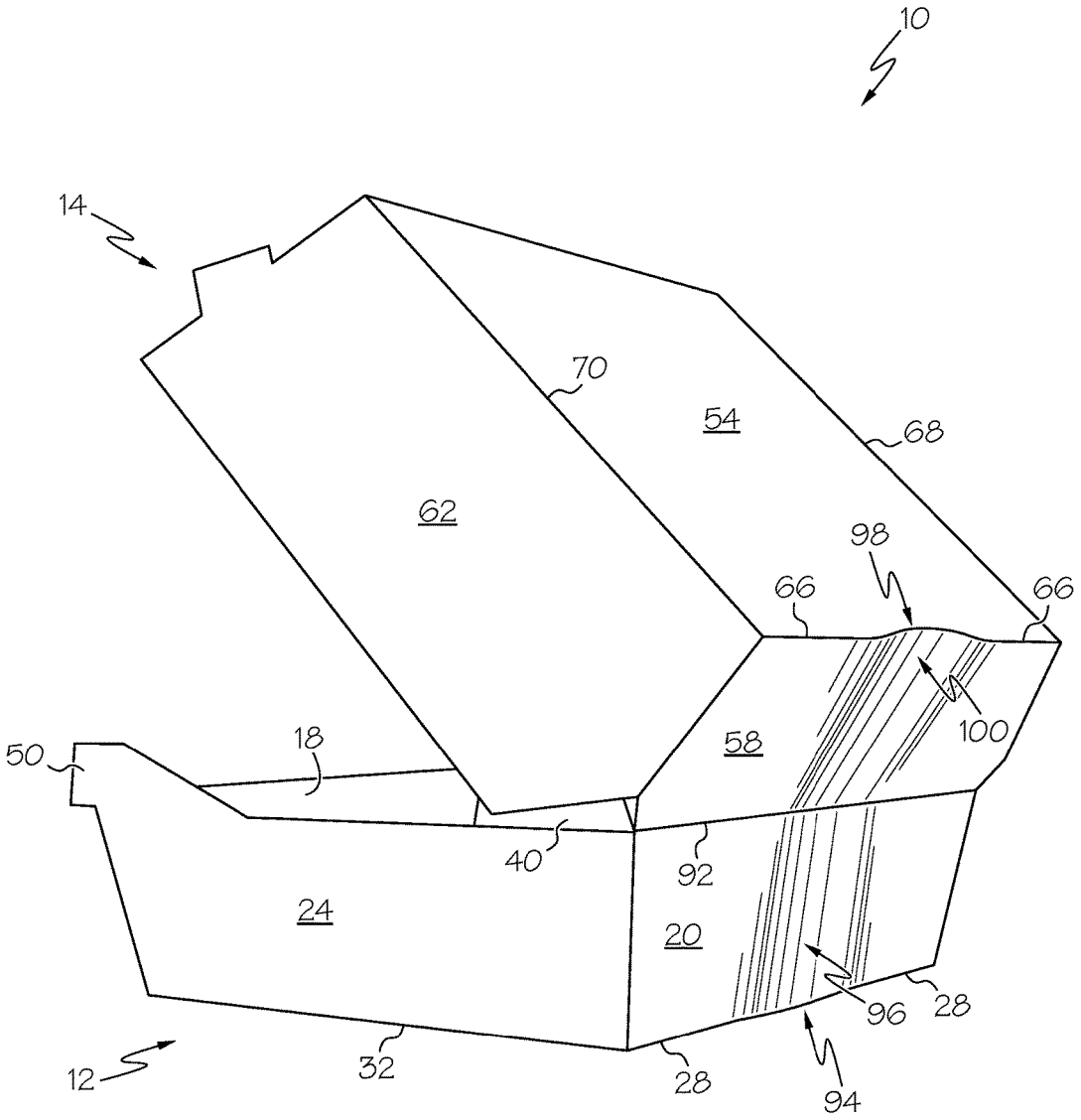
FIG. 2 is a rear perspective view of a clamshell container constructed according to one embodiment of the present invention.

Referring to FIGS. 1 and 2, the container 10 of the present invention, which may be constructed as a clamshell carton, includes a tray portion 12 and a cover portion 14 that is selectively movable between opened and closed positions relative to the tray portion 12. As discussed in further detail below, the carton 10 includes an anti-bind feature adapted for significantly minimizing or entirely eliminating budding, binding or tearing as the cover 14 is moved between open and closed positions.

As illustrated, the tray 12 comprises five primary panels including a first or bottom panel 16 and a front panel 18, rear panel 20 and end panels 22 and 24 that are foldably connected to the bottom panel 16 by score lines or fold lines 26, 28, 30 and 32, respectively. When the tray 12 is in an upright position, the panels 18, 20, 22 and 24 extend generally upwardly from the bottom panel 16 to form a peripheral sidewall defining an interior of the tray 12.

The tray 12 may further include flaps 34, 36, 38 and 40 extending from any of the front, rear and end panels 18, 20, 22 and 24 configured for securement to an adjacent panel. As shown, the flaps 34, 36, 38 and 40 extend from and are foldably connected to side edges of the front and rear panels 18 and 20 by score lines or fold lines 42, 44, 46 and 48, respectively. The flaps 34, 36, 38 and 40 may be affixed to the end panels 22 and 24 when the tray 12 is formed. Securement of the flaps 34, 36, 38 and 40 can be achieved by adhesive, sonic welding, heat-sealable materials, sealant or the like. The tray 12 may further include forward projecting hooks or detents 50 and 52 which may be constructed from portions of the end panels 24, 22 and flaps 34, 36 to form sturdy, double thickness latch detents.

As shown, the cover 14 comprises five primary panels including a first or top panel. 54 and a front panel 56, rear panel 58 and end panels 60 and 62 that are foldably connected to the top panel 54 by score lines or fold lines 64, 66, 68 and 70, respectively. When the cover 14 is in a closed position, the panels 56, 58, 60 and 62 extend generally downwardly from the top panel 54 to form a peripheral sidewall defining an interior of the cover 14.

The cover 14 may further include flaps 72, 74, 76 and 78 extending from any of the front, rear or end panels 56, 58, 60 or 62 configured for securement to an adjacent panel. As depicted, flaps 72 and 74 extend from and are foldably connected to front edges of the end panels 62 and 60 by score lines or fold lines 80 and 82, respectively. The flaps 72 and 74 may be affixed to the front panel 56 when the cover 14 is forisied. As further depicted, flaps 76 and 78 extend from and are foldably connected to side edges of the rear panel 58 by score lines or fold lines 84 and 86, respectively. The flaps 76 and 78 may be affixed to the end panels 60 and 62, respectively, when the cover 14 is formed. The cover 14 may further include openings 88 and 90 defined in flaps 72 and 74 suitable for receiving the hooks 50 and 52 of the tray 12 in order to maintain the cover 14 in a closed position relative to the tray 12.

The rear tray panel 20 and the rear cover panel 58 are joined together by a hinge line 92 which bin gedly connects the cover 14 to the tray 12.

The first or bottom tray panel 16 may be at least partially joined and foldably connected to the rear tray panel 20 along a rear tray fold line 28. A first rear cut 94 may be provided and is shown as interrupting the rear tray fold line 28. The first rear cut 94 can be adapted for allowing at least a portion of the rear tray panel 20 to flex or bow in order to minimize or entirely eliminate buckling, binding or tearing as the cover 14 is moved between open and closed positions relative to the tray 12.

Figure 3:
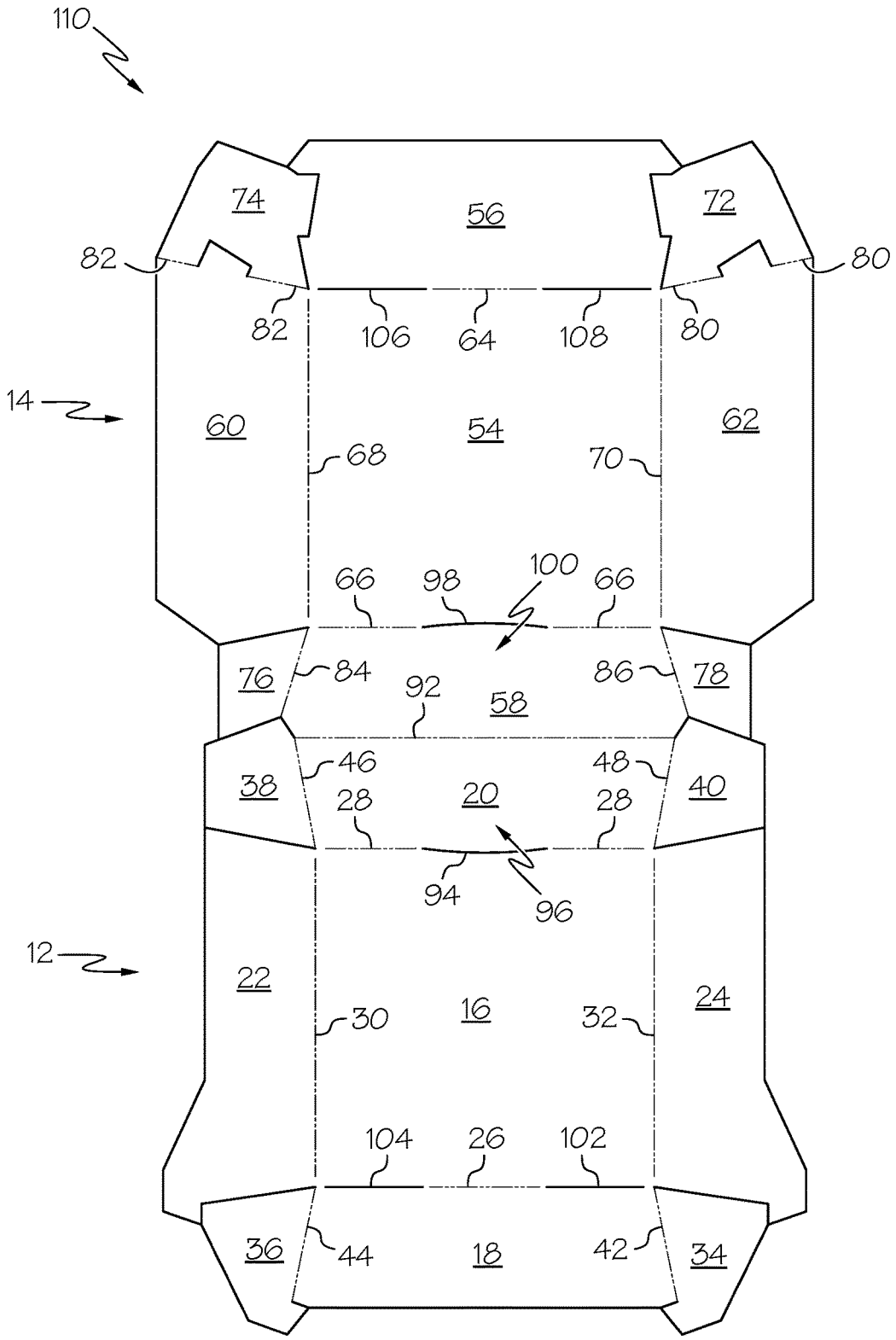
FIG. 3 is a plan view of a unitary blank from which a clamshell container is constructed according to one embodiment of the present invention.

In one embodiment, the first rear cut 94 is defined proximate a middle or central section of the rear tray fold line 28. In that manner, the rear tray fold line 28 may be understood to be a single fold line that is broken or interrupted by the cut 94 or, alternatively, the rear tray fold line 28 may be understood as being in the form of two separate fold lines disposed on either side of the cut 94. The first rear cut 94 may intersect the rear tray fold line 28 and, in one instance, is generally coextensive or in axial alignment with the rear tray fold line 28. As best illustrated in FIG. 3, the first rear cut 94 may take on an arcuate shape in order to promote flexing or bowing of the rear tray panel 20. Accordingly, in one design, the first rear cut 94 is convexly curved in the direction of the tray bottom panel 16. The ends of the first rear cut 94 may be adjacent the rear tray fold line 28, while a central portion of the first rear cut 94 may deviate from the linear axis of the rear tray fold line 28. However, it will be understood that the first rear cut 94 may be generally linear or take on any other suitable shape, curvature, profile or contour. As best demonstrated in FIG. 1, the first rear cut 94 can be adapted for allowing a middle portion 96 of the rear tray panel 20 to flex, bow or be slightly displaced inwardly as the cover 14 is hingedly rotated relative to the tray 12.

The first or top cover panel 54 may be at least partially joined and foldably connected to the rear cover panel 58 along a rear cover fold line 66. A second rear cut 98 may be provided and is shown as interrupting the rear cover fold line 66. The second rear cut 98 can be adapted for allowing at least a portion of the rear cover panel 58 to flex or bow in order to minimize or entirely eliminate buckling, binding or tearing as the cover 14 is moved between open and closed positions relative to the tray 12.

In one embodiment, the second rear cut 98 is defined proximate a middle or central section of the rear cover fold line 66. In that manner, the rear cover fold line 66 may be understood to be a single fold line that is broken or interrupted by the cut 98 or, alternatively, the rear cover fold line 66 may be understood as being in the form of two separate fold lines disposed on either side of the cut 98. The second rear cut 98 may intersect the rear cover fold line 66 and, in one instance, is generally coextensive or in axial alignment with the rear cover fold line 66. As best illustrated in FIG. 3, the second rear cut 98 may take on an arcuate shape in order to promote flexing or bowing of the rear cover panel 58. Accordingly, in one design, the second rear cut 98 is convexly curved in the direction of the cover top panel 54. The ends of the second rear cut 98 may be adjacent the rear cover fold line 66, while a central portion of the second rear cut 98 may deviate from the linear axis of the rear cover fold line 66. However, it will be understood that the second rear cut 98 may be generally linear or take on any other suitable shape, curvature, profile or contour. As best demonstrated in FIG. 1, the second rear cut 98 can be adapted for allowing a middle portion 100 of the rear cover panel 58 to flex, bow or be slightly displaced inwardly as the cover 14 is hingedly rotated relative to the tray 12.

The first and second anti-buckling rear cuts 94 and 98 may be in the form of die cuts created during the cutting of the blank 110 from which the container 10 may be constructed, as further described below. It will further understood that the first and second rear cuts 94 and 98 may take the form of a slit, slot, incision, opening, aperture or any other cut suitable for achieving the purposes described herein.

Turning attention now to the front part of the container 10, the first or bottom tray panel 16 may be at least partially joined and foldably connected to the front tray panel 18 along a front tray fold line 26. First and second front cuts 102 and 104 may be provided generally coextensive or in axial alignment with the front tray fold line 26. As shown in FIG. 3, the first and second front cuts 102 and 104 are laterally offset from the first rear cut 94. In other words, the first and second front cuts 102 and 104 may be offset to the left and right of the first rear cut 94, which can be generally laterally in line with the front tray fold line 26. In that manner, the first and second front cuts 102 and 104 can be positioned adjacent the outer sides of the container 10, while the first rear cut 94 is positioned towards a center portion of the container 10. In one embodiment, the first front cut 102 is located proximate one end of the front tray fold line 26 and the second front cut 104 is located proximate an opposing end of the front tray fold line 26.

The first or top cover panel 54 may be at least partially joined and foldably connected to the front cover panel 56 along a front cover fold line 64. Third and fourth front cuts 106 and 108 may be provided generally coextensive or in axial alignment with the front cover fold line 64. As shown in FIG. 3, the third and fourth cuts 106 and 108 are laterally offset from the second rear cut 98. In other words, the third and fourth front cuts 106 and 108 may be offset to the left and right of the second rear cut 98, which can be generally laterally in line with the front cover fold line 64. In that manner, the third and fourth front cuts 106 and 108 can be positioned adjacent the outer sides of the container 10, while the second rear cut 98 is positioned towards a center portion of the container 10. In one embodiment, the third front cut 106 is located proximate one end of the front cover fold line 64 and the fourth front cut 108 is located proximate an opposing end of the front cover fold line 64.

The container 10 may be constructed of paperboard, laminated paperboard, cardboard, polymers, thermoplastic materials, molded pulp fiber, laminated molded pulp fiber or any other suitable material now known or hereafter developed. The container 10 may be coated on its interior and/or exterior surfaces with a waterproof or water-resistant material such as polyethylene, polypropylene or polyester. Other types of waterproof, water-resistant or heat-sealable coatings that are now known or hereafter developed may also be used. Various methods of applying the coating are well known in the art. Exposed edges of the container 10 can be sealed to prevent the migration of liquids. Optionally, the container 10 may be constructed as being generally leakproof and beads of adhesive or sealant may be applied at its seams. The exterior surfaces of the container 10 may be suitable for having advertising, logos and other graphics printed thereon.

While the figures illustrate a four-sided or box-shaped container 10, it will be appreciated that other container configurations and shapes are within the scope of the present invention. For example, the anti-bind feature disclosed herein may be utilized with a three-sided carton (e.g., carton for a slice of pie) among other containers of other shapes.

As illustrated in FIG. 3, the carton 10 can be constructed from a flat sheet or single blank 110 of material that is die cut from a larger sheet or roll of material (not shown). Score lines and/or fold lines may be stamped, rolled, embossed or otherwise formed in the blank 110 to facilitate formation of the container 10 in a folding process. In FIG. 3, score lines or fold lines are represented as phantom (broken) lines, while cut lines are represented as solid lines. Upon being cut, the blank 110 may be folded to form the container 10.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar temis as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A clamshell container formed from a single blank of material, said container comprising:

a tray including a first tray panel and a rear tray panel extending from said first tray panel, said first tray panel and said rear tray panel being foldably connected along a rear tray fold line;

a cover including a first cover panel and a rear cover panel extending from said first cover panel, said first cover panel and said rear cover panel being foldably connected along a rear cover fold line; and a rear cut defined as at least one of a slit, a slot, an incision, an opening and an aperture through at least one of said first tray panel, said rear tray panel, said first cover panel, said rear cover panel, said rear tray fold line, and said rear cover fold line;

wherein said rear cut interrupts at least one of said rear tray fold line and said rear cover fold line at an intermediate position of said rear tray fold line or said rear cover fold line;

and wherein when said cover is rotated relative to said tray, at least one of said rear tray panel and said rear cover panel includes an inwardly displaced portion.

2. The clamshell container of claim 1, wherein said rear cut is proximate a mid-section of at least one of said rear tray fold line and said rear cover fold line.

3. The clamshell container of claim 1, wherein said rear cut intersects at least one of said rear tray fold line and said rear cover fold line.

4. The clamshell container of claim 1, wherein said rear cut is generally coextensive with at least one of said rear tray fold line and said rear cover fold line.

5. The clamshell container of claim 1, wherein said rear tray fold line is interrupted by a first said rear cut and said rear cover fold line is interrupted by a second said rear cut.

6. The clamshell container of claim 1, wherein said rear tray panel and said rear cover panel are hingedly connected to one another at a hinge line.

7. The clamshell container of claim 1, wherein said rear cut is adapted for allowing at least a portion of at least one of said rear tray panel and said rear cover panel to flex as said cover is moved relative to said tray.

8. The clamshell container of claim 1 further comprising:

a front tray panel extending from said first tray panel, said first tray panel and said front tray panel being foldably connected along a front tray fold line;

a front cover panel extending from said first cover panel, said first cover panel and said front cover panel being foldably connected along a front cover fold line; and a front cut generally coextensive with at least one of said front tray fold line and said front cover fold line.

9. The clamshell container of claim 8, wherein said front cut is at least partially laterally offset from said rear cut.

10. The clamshell container of claim 9, wherein at least one of said front tray fold line and said front cover fold line is generally coextensive with two said front cuts, said front cuts each being proximate opposing ends of at least one of said front tray fold line and said front cover fold line.

11. A clamshell container formed from a single blank of material, said container comprising:

a tray including a first tray panel and a rear tray panel extending from said first tray panel, said first tray panel and said rear tray panel being foldably connected along a rear tray fold line; and a cover including a first cover panel and a rear cover panel extending from said first cover panel, said first cover panel and said rear cover panel being foldably connected along a rear cover fold line;

a first rear cut being generally coextensive with and interrupting a mid-section of said rear tray fold line, said first rear cut defined through at least one of said first tray panel and said rear tray panel forming an opening between said first tray panel and said rear tray panel; and a second rear cut being generally coextensive with and interrupting a mid-section of said rear cover fold line, said second rear cut defined through at least one of said first cover panel said rear cover panel forming an opening between said first cover panel and said rear cover panel;

wherein each of said first rear cut and said second rear cut are defined as at least one of a slit, a slot, an incision, an opening and an aperture; and wherein when said cover is rotated relative to said tray, at least a portion of said rear tray panel is displaced inwardly, and at least a portion of said rear cover panel is displaced inwardly.

12. A foldable blank for forming a clamshell container, said blank comprising:

a tray portion including a first tray panel and a rear tray panel extending from said first tray panel, said first tray panel and said rear tray panel being foldably connected along a rear tray fold line;

a cover portion including a first cover panel and a rear cover panel extending from said first cover panel, said first cover panel and said rear cover panel being foldably connected along a rear cover fold line; and a rear cut interrupting at least one of said rear tray fold line and said rear cover fold line at an intermediate position of said rear tray fold line or said rear cover fold line, wherein said rear cut is arcuate, and wherein said rear cut is defined as at least one of a slit, a slot, an incision, an opening and an aperture through said at least one of said rear tray fold line and said rear cover fold line;

wherein upon formation of said container, when said cover portion is rotated relative to said tray portion, at least a portion of least one of said rear tray panel and said rear cover panel is displaced inwardly.

13. The blank of claim 12, wherein said rear cut is proximate a mid-section of at least one of said rear tray fold line and said rear cover fold line.

14. The blank of claim 12, wherein said rear cut is generally coextensive with at least one of said rear tray fold line and said rear cover fold line.

15. The blank of claim 12, wherein a center portion of at least one of said rear tray panel and said rear cover panel bows inwardly as said cover portion is hingedly rotated relative to said tray portion upon formation of said container.

16. The blank of claim 12 further comprising:

a front tray panel extending from said first tray panel, said first tray panel and said front tray panel being foldably connected along a front tray fold line;

a front cover panel extending from said first cover panel, said first cover panel and said front cover panel being foldably connected along a front cover fold line; and a front cut generally coextensive with at least one of said front tray fold line and said front cover fold line.

* * * * *